US008212688B2

(12) United States Patent
Morioka et al.

(10) Patent No.: US 8,212,688 B2
(45) Date of Patent: Jul. 3, 2012

(54) TRAFFIC SIGNALS CONTROL SYSTEM

(75) Inventors: Nobuyuki Morioka, Kensington (AU); Eric Enyang Huang, Cambridge, MA (US); Bernhard Hengst, North Sydney (AU)

(73) Assignee: Roads and Traffic Authority of New South Wales, North Sydney NSW (AU)

( * ) Notice: Subject to any disclaimer, the term of this patent is extended or adjusted under 35 U.S.C. 154(b) by 435 days.

(21) Appl. No.: 12/478,670

(22) Filed: Jun. 4, 2009

(65) Prior Publication Data

US 2009/0322561 A1 Dec. 31, 2009

(30) Foreign Application Priority Data

Jun. 4, 2008 (AU) ..... 2008902826

(51) Int. Cl.
*G08G 1/07* (2006.01)

(52) U.S. Cl. ..... 340/920; 340/907; 340/910; 340/911; 340/917; 701/118

(58) Field of Classification Search ..... 340/907–924; 701/117, 118
See application file for complete search history.

(56) References Cited

U.S. PATENT DOCUMENTS

| | | | | |
|---|---|---|---|---|
| 5,444,442 | A * | 8/1995 | Sadakata et al. | 340/916 |
| 6,313,757 | B1 * | 11/2001 | Braun | 340/917 |
| 6,937,161 | B2 * | 8/2005 | Nishimura | 340/917 |
| 2005/0190975 | A1 * | 9/2005 | Porikli et al. | 382/235 |
| 2007/0273552 | A1 * | 11/2007 | Tischer | 340/910 |

* cited by examiner

*Primary Examiner* — Brent Swarthout
(74) *Attorney, Agent, or Firm* — Duane Morris LLP

(57) ABSTRACT

A method of controlling traffic signals at a road intersection, which has a plurality of signal groups, each of which controls at least one direction of traffic within the intersection. The method comprises the steps of obtaining and utilizing traffic data to calculate a current traffic state and the rate of change in the traffic state. The method further comprises formulating at least one action and the duration of the action in response to these calculations. Each action comprises switching at least one traffic signal. One or more policies based on the calculations and the action are resolved. A continuous decision making process is applied to evaluate a reward for the policies resolved and a policy that maximizes the reward is selected.

29 Claims, 7 Drawing Sheets

TRAFFIC SIGNALS CONTROL SYSTEM

RELATED APPLICATIONS

The present application claims priority benefit to Australian Patent Application No. 2008902826, filed Jun. 4, 2008, entitled "Traffic Signals Control System", the entirety of which is hereby incorporated by reference.

TECHNICAL FIELD

The present invention relates to a method for controlling traffic lights at intersections.

In particular, the present invention relates to a system and to a software platform for carrying out a method of controlling and switching of signal groups at intersections to optimise the flow of traffic based on utility functions. The signal groups comprise a set of lights such as red, green, yellow and off (no lights), that are always switched simultaneously. The method further includes the steps of detecting the point in time when a queue of vehicles at an intersection has fully discharged at traffic lights based on the signals from at least a single loop-detector located at the stop line. The method also estimates the average traffic flow using the Kalman Filter.

The present invention can be a module of a traffic control system which monitors and controls the traffic on roads.

BACKGROUND ART

With ever increasing volumes of road traffic, improvements in the performance of traffic signal control systems can be a cost-effective way to potentially reduce social, economic and environmental impacts, which arise from traffic congestion. Such improvements may not only delay the onset of traffic congestion but can also avoid expensive and time consuming additions to road network infrastructure.

Many traffic control systems in use around the world are time-based and use switching plans developed manually by collecting traffic patterns for each time of the day. These plans are fixed and do not respond at all to unexpected real time changes in traffic flow.

Traditionally, traffic control systems are equipped with adaptive fixed phase controllers where traffic lights are usually switched in a sequence through several repeating phases. Conventional traffic control systems cannot provide adequate utilisation of controlled intersections. As a result, there is usually a long average waiting time for vehicles to cross intersections that are controlled by conventional traffic control systems.

Adaptive control systems such as SCOOT (Split Cycle Offset Optimization Technique) and SCATS (Sydney Coordinated Adaptive Traffic System), were first developed a few decades ago and they use adaptive phase control where the lights are switched through several phases in a cyclic sequence. Traffic engineers manually select the phases and predefine their ordering. The systems make real time adjustments in the time between each phase. The real time adjustments are based on the measurements of the traffic flow saturation levels.

However, these adaptive phase systems are still not capable of adapting to unanticipated flow patterns. None of the previously devised adaptive control systems can provide a greater degree of flexibility than controlling individual signal groups. The known adaptive control systems demonstrate significant drawbacks when unplanned traffic flow conditions are encountered. This is because these existing adaptive controllers are limited to switching between a limited number of phases in a predetermined order.

Moreover, historically the controlling methodologies that are applied in conventional traffic controlled systems employed a different way to estimate the end-of-queue time and green light time. Previously, for example, gap detection has been used to help switch traffic lights and SCATS balanced the degree of saturation (DoS) at a target DoS to update green light time for phases. These techniques are sensitive to variations, and are unable to allow the system to respond quickly to high rates of traffic flow changes.

It would therefore be an advantage to deliver a solution that works optimally for controlling traffic lights at intersections, which is able to plan a control policy for a high dimensional complex, probabilistic, non-linear system, subject to signal switching constraints and traffic behaviour.

It would also be advantageous to provide an improved method and system for controlling traffic lights at intersections. This would overcome at least some of the disadvantages of previously known approaches in this field, or would provide a useful alternative.

DISCLOSURE OF THE INVENTION

According to a first aspect of the present invention, there is provided A method of controlling traffic signals at a road intersection which has a plurality of signal groups, each of which controls at least one direction of traffic within the intersection, the method comprising the steps of: obtaining and utilising traffic data to calculate a current traffic state and the rate of change in the traffic state; formulating at least one action and the duration of said action in response to the calculations obtained in step (i), wherein each action comprises switching at least one traffic signal; resolving one or more policies based on the calculations obtained in step (i) and the action formulated in step (ii); applying a continuous decision making process to evaluate a reward for the policies resolved in step (iii); and selecting a policy that maximizes the reward.

Preferably, the current traffic state comprises one or more of traffic queue length, vehicle speed, vehicle position, vehicle type, and arrival rate.

Alternatively, the current traffic state comprises a traffic queue length and the rate of change is the rate of growth of the traffic queue.

Preferably, the continuous decision making process comprises a semi-Markov Decision Process.

Preferably, the continuous decision making process comprises an optimisation for the semi-Markov Decision Process.

Preferably, the optimisation comprises the steps of: generating a policy pathway comprising a plurality of different paths, each path having a one or more nodes, which represent at least one policy; and evaluating a reward for each path in the policy pathway by evaluating and totaling the reward of the policies located at each node along each one of the different paths.

Preferably, the optimisation is adapted to terminate when a termination condition is reached within the policy pathway.

Preferably, the termination condition is selected from one or more of the node count limit, the time count limit or the storage count limit.

Preferably, the evaluated reward is a value of a function for optimising at least one traffic condition.

Preferably, the traffic condition is any one or more of vehicle fuel consumption, pollution, the number of vehicle stops, vehicle waiting time and time delay.

Preferably, the continuous decision making process comprises a set of states and a set of actions for transitioning between states and a policy comprises mapping states to actions, wherein a state comprises at least one signal group state and one traffic state.

Preferably, the signal group state comprises a plurality of signals and a counter for each signal.

Preferably, the signals comprise red and green.

Preferably, the counter stores an amount of time remaining before the signal can be switched.

Preferably, the traffic data is collected by the use of sensors.

Preferably, the sensor comprises any one or more of loop detector, video camera, radar device, infra-red sensor, RFID tag or GPS device.

Preferably, the step of calculating the traffic state comprises the step of determining the end-of-queue of the incoming traffic.

Preferably, the end-of-queue is determined using total space-time and number of spaces.

According to a second aspect of the present invention, there is provided a traffic signals control system comprising a control means for controlling actuators for the controlling of traffic signals at a road intersection which has a plurality of signal groups, each of which controls at least one direction of traffic within the intersection, and a traffic modeling means arranged to receive traffic data from a sensor means, the control means being operable to: obtain and utilise the traffic data to calculate a current traffic state and the rate of change in the traffic state; formulate at least one action and the duration of said action in response to the calculations obtained in step (i), wherein each action comprises switching at least one traffic signal; resolve one or more policies based on the calculations obtained in step (i) and the action formulated in step (ii); apply a continuous decision making process to evaluate a reward for the policies resolved in step (iii); and select a policy that maximizes the reward.

Preferably, the current traffic state comprises one or more of traffic queue length, vehicle speed, vehicle position, vehicle type, and arrival rate.

Preferably, the current traffic state comprises a traffic queue length and the rate of change is the rate of growth of the traffic queue.

Preferably, the continuous decision making process comprises a semi-Markov Decision Process.

Preferably, the continuous decision making process comprises an optimisation for the semi-Markov Decision Process.

Preferably, the optimisation includes: generating a policy pathway comprising a plurality of different paths, each path having a one or more nodes, which represent at least one policy; and evaluating a reward for each path in the policy pathway by evaluating and totaling the reward of the policies located at each node along each one of the different paths.

Preferably, the optimisation is adapted to terminate when a termination condition is reached within the policy pathway.

Preferably, the termination condition is selected from one or more of the no de count limit, the time count limit or the storage count limit.

Preferably, the evaluated reward is a value of a function for optimising at least one traffic condition.

Preferably, the traffic condition is any one or more of vehicle fuel consumption, pollution, the number of vehicle stops, vehicle waiting time and time delay.

Preferably, the continuous decision-making process comprises a set of states and a set of actions for transitioning between states and a policy comprises mapping states to actions, wherein a state comprises at least one signal group state and one traffic state.

Preferably, the signal group state comprises a plurality of signals and a counter for each signal.

Preferably, the signals comprise red and green.

Preferably, the counter stores an amount of time remaining before the signal can be switched.

Preferably, the traffic data is collected by the use of sensors.

Preferably, the sensor comprises any one or more of loop detector, video camera, radar device, infra-red sensor, RFID tag or GPS device.

Preferably, calculating the traffic state comprises the step of determining the end-of-queue of the incoming traffic.

Preferably, the end-of-queue is determined using total space-time and number of spaces.

Thus, the present invention provides the advantages referred to above. These and other advantages are met with the present invention, which a broad form are set out in the "Claims" section at the end of this description, which additionally discloses optional and preferred aspects of the invention. These embodiments are not necessarily limiting on the invention, which is described fully in this entire document.

BRIEF DESCRIPTION OF DRAWINGS

The invention is now described by way of example only, with reference to the accompanying drawings, where.

DESCRIPTION OF THE INVENTION

The present invention relates to a method and a system for controlling traffic lights at intersections. The present invention particularly relates to an intelligent traffic signals control system. The design of the traffic signals control system is based on an intelligent agent architecture, which can perceive its environment through sensors and act upon that environment through actuators.

Figure 1:
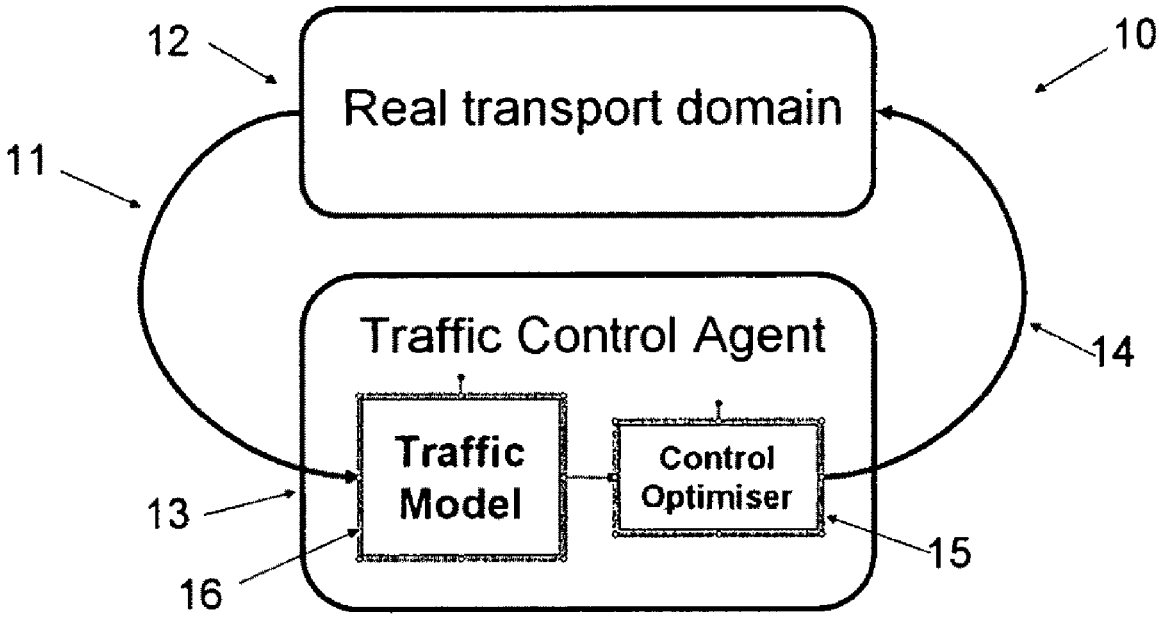
FIG. 1 is a diagrammatic representation of the high level architecture according to an embodiment of the present invention.

FIG. 1 shows a high level architecture of the traffic signals control system 10 ("TSCS") according to a first embodiment of the present invention. The architecture is based on a sense-act agent model. The arrow 11 from the real transport domain 12 to the control agent 13 represents incoming sensor data and the other arrow 14 represents the actuator data. In the TSCS 10, sensors typically include loop detectors and video cameras, radar devices, infra-red sensors, radio frequency identification (RFID) tags or Global Positioning System (GPS) devices or any other suitable sensors, and the actuators typically include the traffic light settings for signal groups, variable message signs and communications sent directly to vehicles.

Given a continuous flow of sensor data, the goal of the TSCS 10 is to find a sequence of actions that optimizes some criteria within the constraints of the system. These optimisation criteria may include minimising vehicle fuel consumption, minimising pollution, minimising number of stops, minimising waiting time and minimising delay, or indeed a weighted combination of one or more of these criteria. For example, one embodiment of the TSCS 10 of the present invention is configured to minimise the total waiting time of all vehicles at an intersection. The TSCS 10 receives sensor data from a loop detector and thereby generates action events for switching traffic lights. The control system can also be extended to use more sophisticated sensing, traffic models and objective functions.

As shown in FIG. 1 the TSCS 10 consists of two main components, a control means in the form of a controller/optimiser 15 and a traffic modelling means in the form of a traffic model 16. The controller/optimiser 15 calculates and implements the control action, given the model state and an optimization criterion. The model state is described continuously by the traffic model 16, which receives sensor data regarding the traffic conditions. The Control/Optimiser 15 also searches for a preferable policy by predicting future outcomes, based on the available control actions in each state of the model. In a preferred embodiment of the present invention, the policy may be cached to save future re-computations should a similar traffic situation reoccur.

The Control/Optimiser 15 can also plan an optimal forward control policy that is subjected to signal switching constraints and traffic behaviour. This is performed using a forward search to evaluate the objective function. One of the forward search algorithms is based on an efficient technique similar to A*, together with an algorithm that can return a solution under time constraints. A* is a best-first, graph search algorithm that finds the least-cost path from a given initial node to one goal node (out of one or more possible goals). It uses a distance-plus-cost heuristic function (usually denoted f(x)) to determine the order in which the search visits nodes in the tree. The distance-plus-cost heuristic is a sum of two functions: the path-cost function (usually denoted g(x)), which may or may not be a heuristic, and an admissible "heuristic estimate" of the distance to the goal (usually denoted h(x)). The path-cost function g(x) is the cost from the starting node to the current node.

Since the h(x) part of the f(x) function must be an admissible heuristic, it must underestimate the distance to the goal. Thus for an application like routing, h(x) might represent the straight-line distance to the goal, since that is physically the smallest possible distance between any two points (or nodes for that matter).

The calculation and implementation making process is event driven in continuous time and allows the calculations to be later evaluated for variable time intervals.

Semi-Markov Decision Process Formulation

In a preferred embodiment of the present invention, the control/optimiser 15 applies Markov decision processes ("MDP") or semi-Markov decision processes ("SMDP") for determining control actions.

An MDP consists of a (finite or infinite) set of states S, and a (finite or infinite) set of actions A for transitioning between states. Transitions from any state $s \in S$ to any other state $s' \in S$ given any action $a \in A$ are defined by a transition function $S \times A \times S \rightarrow [0,1]$ where [0,1] is the transition probability. Similarly, given the state s, action a and next state s', a reward function provides the expected immediate utility for this transition and is defined as $S \times A \rightarrow \Re$.

Figure 2A:
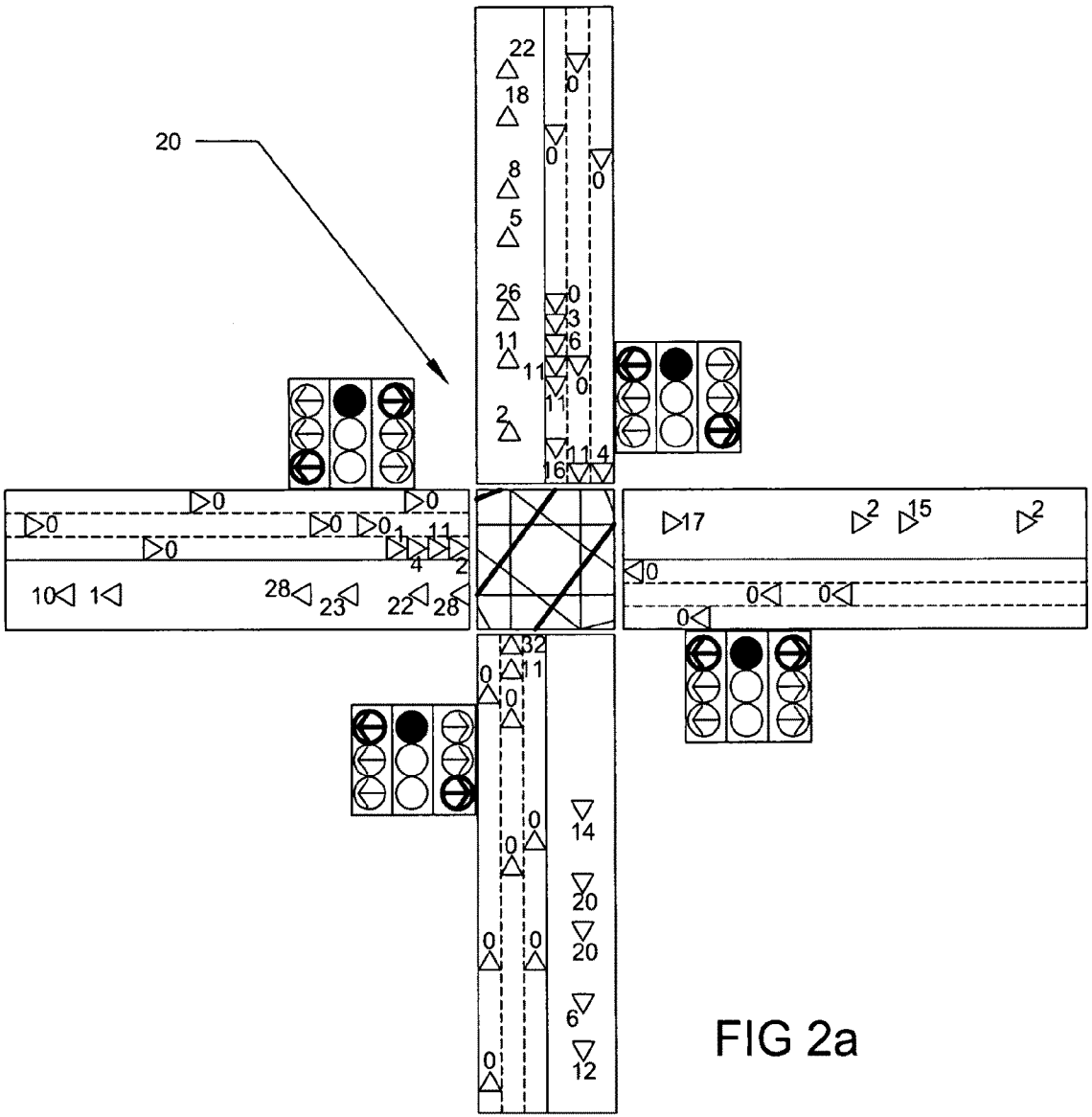
FIG. 2*a* is a diagrammatic representation of an intersection for implementing an embodiment of the present invention.
Figure 2B:
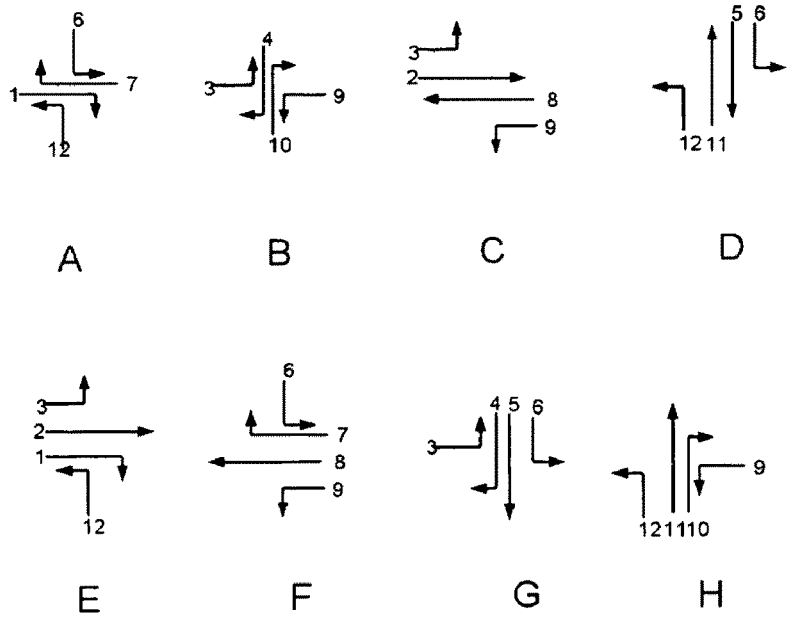
FIG. 2*b* is a diagrammatic representation of a constrained set of signal group movements defined in an embodiment of the present invention.

In one embodiment, the action space A is defined as the control options to a subset of all possible signal group sets. For Example, as shown in FIG. 2*a*, there is shown a single intersection 20 with twelve approaches, and each approach is controlled by one signal group. The signal groups are numbered from 1 to 12 clockwise starting from the west originating traffic flow turning right. FIG. 2*b* shows the constrained set of signal group movements used as available target options for the intersection 20. For this intersection, each signal group is associated with one traffic movement. In this embodiment, the action space includes eight constraint sets, which are shown in FIG. 2*b*. Depending on the resources available, the system may consider an action space having all possible sets of active signals, which can be executed concurrently under given constraints.

In an MDP, the amount of time intervals between decision stages is not relevant. Rather, only the sequential nature of the decision process is relevant. An MDP is a one-step action model where every action is assumed to take a fixed unit of time to transition between states. A SMDP generalizes this action model such that it allows the amount of time between one decision and the next to be variable. In a SMDP, the time interval can also either be a real number or an integer.

The objective is to determine which action to take in any state to maximise future rewards. This mapping from states to actions $S \rightarrow A$ is called a policy and is written as $\pi(s)=a$. The traffic signals control can be modelled as an infinite horizon or continuing SMDP. This means that state transitions do not terminate but continue forever. A discounted value function and an average reward value function can ensure that the function of future rewards that are to be maximised is bounded.

For traffic signal control, a state s can be defined by a combination of signal group states and a traffic state. A signal group state is defined for each signal group at an intersection. It consists of a signal colour and two timers. In one embodiment the signal colour is either green or red and the timers are for counting down the time remaining before the signal can be switched between green and red. The traffic state corresponds to any information in the traffic network other than the signal group states. The other information that the traffic state corresponds to includes the queue length on each approach of an intersection, vehicle type, its position and velocity and the average arrival rate of vehicles. The richer the state description is, the larger the search space will be and the more resources are required for processing.

In one embodiment of the present invention, the control/optimiser 15 uses a flow based traffic model that simply describes the traffic state using two variables for each signal group. These variables are the rate of growth of the queue and the current queue length. There are two benefits of using these two variables. Firstly, this model suits the impoverished data available from loop detectors and secondly it reduces the hypothesis space for searching an optimal policy. This can maintain the efficiency of MDP and SMDP, which may not scale well with large number of state variables.

Event Driven Semi-Markov Decision Processes

As described above, in a MDP, the state transitions defined in the model can only take one unit of time. However, in the present invention, it is preferable that the model has variable times taken between actions. These actions are called temporarily extended actions in the formulation of a SMDP.

The purpose of the temporarily extended actions is to generate a sequence of so-called "primitive actions" into one so-called "macro action" that reduces the number of so-called "decision points", which are associated with events. By using temporarily extended actions, the signal control system becomes an event driven system, thereby significantly reducing the complexity of the decision making processes.

In such an event driven system, events are triggered when one of the currently active signals terminates. Until the active signals are terminated, the control actions cannot be interrupted. Each event generates a decision point where the system must decide which control action to take next. The start and end of a signal are determined by several constraints or rules imposed on the signals. Some of these constraints are specified by traffic authorities while others represent heuristics to reduce the hypothesis space to be searched. Some of the possible constraints are listed as follows:

- Minimum green light time for each signal;
- Maximum red light time for each signal;
- Self inter-green light time for each signal;
- Inter-green light time between conflicted signals;
- Traffic queues being discharged during one contiguous green light;
- Full or partial ordering of the sequence of signals;
- Signals remaining green unless other concurrently active signals have not reached their end of green light cycle; and
- Choosing control actions from a subset of possible sets of active signals In one embodiment of the present invention, the controller/optimizer 15 introduces approximations to reduce the size of state space, thereby increasing the efficiency in finding an optimal policy. Rather than finding a policy for every state, the TSCS 10 projects state transitions forward in time from the current state and explores and evaluates various short-term control scenarios. In this way the TSCS 10 only needs to explore a subset of states that are reachable under the short-term control scenarios from the current state.

Figure 3:
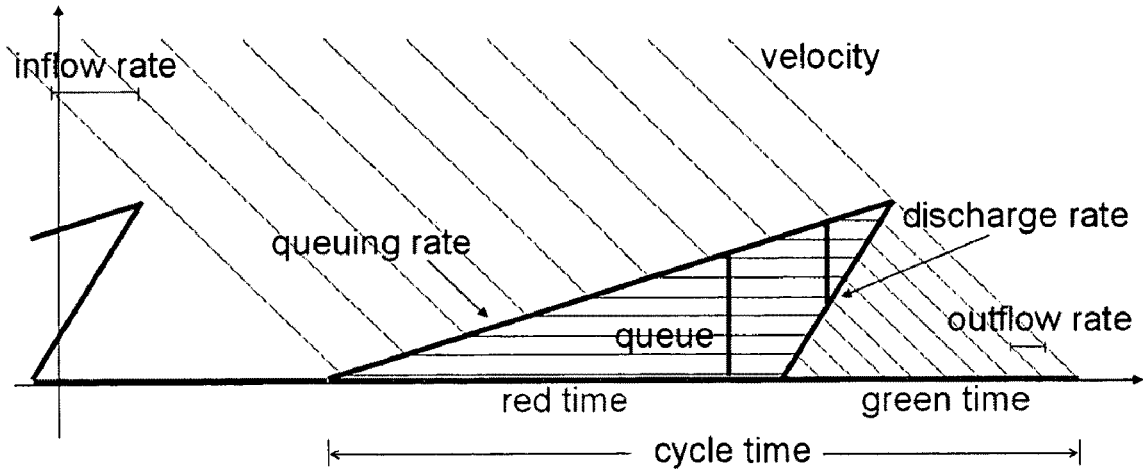
FIG. 3 shows a graphical representation of the traffic model according to an embodiment of the present invention.

It is possible to analytically model the queue formation and discharge for an approach to an intersection based on how long the associated signal is red and green when the under-saturated average traffic flow rate, the saturation flow rate and the vehicle velocity are known. This model is referred to as an analytical flow-based queuing model or analytical queuing model. One example of such a model is shown in FIG. 3. The rate at which the queue grows is called the queuing rate and this can be calculated algebraically from the flow rate and the velocity of the cars entering the queue. Similarly, the rate at which the queue discharges is called the discharge rate and can be calculated from the saturated flow rate and velocity of the cars leaving the queue.

The height of the triangle in FIG. 3 is representative of the length of the queue since the start of red light, subsequent to when all the vehicles were discharged from the queue during the last green light. Using equation 1 below, it is possible to calculate the expected time green time g required to discharge the queue. The equation is derived from the geometry of the model in FIG. 3.

$$g = \frac{qr(v-s)}{v(s-q)} \tag{1}$$

| Variable | Definition | Unit |
|---|---|---|
| q | Rate at the queue grows | Meters/Second |
| s | Queue discharge rate (constant) | Meters/Second |
| v | Average traffic velocity (negative constant) | Meters/Second |
| r | Previous Red Time | Seconds |

This model also allows the system to calculate the total waiting time of vehicles. In FIG. 3, the total waiting time is represented by the area of the triangle. The total waiting time is calculated by integrating the queue over time.

Both the flow rate and the length of the queue vary with time. The traffic flow rate is a variable of the function for obtaining the queuing rate. Therefore, only one of the two variables is required in real time, as the system can convert from one to the other algebraically. The preferred embodiment of the present invention is configured to track the queuing rate from loop detector data. In tracking the queuing rate, the TSCS 10 can effectively count the number of cars that cross the stop line during a red-green light cycle, while also ensuring that the queue has fully discharged and updating the queuing rate using a simple implementation of a Kalman filter. The queuing rate is a part of the traffic state and it varies over a longer timescale than the red-green light cycles of the signal groups.

Traffic Optimization by Forward Search

The direct application of an MDP for modelling traffic with a large state-action space has a high resource demand. Therefore approximate functions are utilised to improve the efficiency of the system. The value function is approximated in real time by conducting a forward search. This forward search operates within time parameters, which are from the current traffic state and signal group state to a "time horizon", which is a pre-determined time in the future. This approximated value function generates a tree of possible future scenarios that can be reached by executing different short-term control policies from the current traffic state.

This approximated value function evaluates the "cost" of each path in the tree by calculating the total waiting time accumulated along that path. In this way the approximated value function approximates the action-value function for the SMDP in real time. The policy for the current state is the first action step in the path that minimises the waiting time. After taking the first step in the optimal path, the system repeats the forward search to revise the schedule of signal switchings. Revising the schedule frequently is necessary when the system does not model the stochasticity of the traffic explicitly. This is because future projections of the traffic model are uncertain and committing to a schedule, which is planned at the beginning is risky.

To conduct the forward search efficiently, the system has employed an A* search method, which is suitable for exploring a tree of such possible future scenarios. The A* search method comprises the following three main steps:

1. Expanding nodes;
2. Forming the Code Function; and
3. Anytime Computation.

Expanding Nodes

Given a node in the search tree, there is a choice of which control actions to take. The node is expanded into several child nodes allowing the system to explore the effects of the possible control actions. The control actions determine the next set of signal groups to switch on. As discussed previously, the algorithm is event driven where decision points are introduced by triggered events. Every node in the search tree corresponds to a decision point. When the system expands a node, its child nodes are created at a time point signifying the next triggered event. Events are triggered when one of the active signals reaches the end of its green light cycle. The sets of active signals to switch on act as targets to reach within the search tree. The path to this target may be interrupted by another event before the target signal group set is reached. Hence it is not necessarily implied that the set of signal groups active at a child node corresponds to the active signal groups in the target. For an example, if the system considers executing a set which has signal group A and B active, signal group A may be switched on before B and reach the end of its green light cycle before signal group B is able to be switched on. Thus, an event is triggered when A is about to end and when only A is active at that moment in time.

As the TSCS 10 projects forward from a node to its child nodes, the TSCS updates traffic states in the child nodes, in response to the corresponding control action. In this way, the analytical queuing model is used to represent the traffic state and queues and waiting times are both updated so that the TSCS 10 can evaluate the child nodes.

The TSCS 10 then selects the next node to expand in the search tree by ordering unexpanded nodes according to the cost function evaluation. A node with the lowest cost is expanded next in the tree and this expansion process is repeated until the termination of the search.

Formulating the Cost Function

In an A* search, nodes are evaluated by summing the cost to reach the current node g(n) and then estimating the cost h(n) to get from this node to the goal.

$$f(n)=g(n)+h(n) \tag{2}$$

To calculate g(n) for a node n, the sum of the total waiting time accumulated along the path from the root of a search tree to the node n is calculated. Using the analytical queuing model, the waiting time can be obtained. It is calculated by integrating queues from the root to the node n as shown in equation 3.

$$g(n)\int_{t_{root}}^{t_n} \text{queue}(t)dt \tag{3}$$

Figure 4:
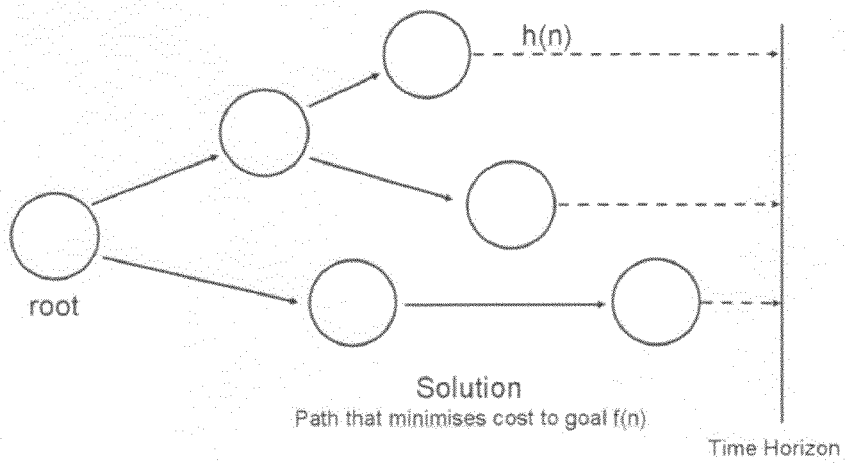
FIG. 4 shows a diagrammatic representation of a flow search according to an embodiment of the present invention.

The calculation of the admissible heuristic h(n) needs to guarantee time optimality of the A* search. In this way, h(n) is admissible only when it does not overestimate the cost to reach the goal. Since the controlling of traffic signals is a continuing task and there are no termination goals to which h(n) is estimated, the system artificially creates a goal by setting a time horizon in the future. This is shown in FIG. 4. The system then minimises the total waiting time to the horizon which is created. Thus, h(n) becomes an estimate of the total waiting time from a node n to the time horizon. This estimate cannot be calculated directly, as the TSCS 10 would not have the information of the exact traffic state at the time horizon, unless the TSCS expands and projects nodes out to that point. Since the TSCS 10 is looking for a path in the search tree that minimises the total waiting time, then at the time horizon the TSCS would do well if it could achieve an average total queue length, which is a fraction less than the original total queue length at the root. Given this intuition, the TSCS 10 estimates h(n) by multiplying the average total queue length by the time interval between the node n and the time horizon, as is shown in equation 4. Although there might be other admissible heuristics which could be employed in the search, the current heuristic of this embodiment of the present invention remains relatively simple.

$$h(n)=\text{queue}(t_{root})\times\text{FACTOR}\times(T-t_n) \tag{4}$$

Finally, the time horizon can be set to any arbitrary point in time in the future, so long as the point in time is far enough in the future so that local minima are avoided as the solution.

Anytime Computations

The A* search is theoretically bounded by an arbitrary time horizon, which is set so far in the future that in practice the time horizon cannot be reached. The further the search is performed into the future, the better the solution to the problem will be. There are however two ways that the search can be limited. The search may be terminated when either the time allocated or the storage allocated is exhausted. The former is called an anytime algorithm, which will return a solution at any time and will usually return a better solution if more time is available. As the algorithm needs to work in a real time environment, the algorithm must be able to compute a solution within some designated time boundaries.

The TSCS 10 of one embodiment of the present invention is configured to limit the search by timing the search process out based on a node limit. If the node count reaches the limit, then the search terminates and the path from the root to the furthest node in the search tree is returned as a solution. It is also possible to use the time remaining before the next control action to be executed as the limit and return a solution in the same way as the above. The A* search algorithm 1 shows the pseudo-code for the current implementation.

Algorithm 1 Forward Search Using A* Search

```
ForwardSearch (node_current )
Q ← Initialised priority queue
T ← Time horizon
L ← Limited on number on nodes
Insert node_current into Q
while Q is not empty do
    if number of nodes has reached L then
        node_furthest ← the furthest node in the search tree
        return a path from node_current to node_furthest
    node ← pop a node with the lowest cost from Q
    if an interval from node_current to node ≧ T then
        return a path from node_current to node
    children ← expand node
    Insert children into Q
```

Further options to improve the performance of the MDP and the SMDP include better traffic flow measurements, optimising the forward search algorithm or using higher fidelity traffic models such as cellar automata.

Regarding the agent architecture, depicted in FIG. 1, the traffic model 16 in one embodiment of the present invention is the analytical queuing model as shown in FIG. 3. This model is used for detecting the point in time when a queue of vehicles has fully discharged at a set of traffic lights, based only on the signal from a single loop-detector located at the stop-line. It provides a measurement of the average traffic flow rate and its variance, given previous red and green light times and it uses a variable gain Kalman filter to update the estimate of average traffic flow rate.

Referring again to FIG. 3, the analytical queuing model describes the state of the environment, which may include the position and speed of cars, the colour of the light signals at an intersection and the average flow rate along links in the network. The model also describes how this state changes in response to chosen control actions and provides the expected utility given each state and action. It includes a sensor model that in general describes the probabilistic relationship between the observation made by the sensors and the model state. The design implements a Bayesian filter that fuses sensor data and models vehicle movements.

A Bayesian filter estimates the state of the TSCS 10 over time based on dynamics of the TSCS and observations (or measurements) of the states. The filter is recursive, and in other words, the next state estimates and observations are made and proceed repeatedly.

Mathematically, the Baysian Filter is described as follows. It is assumed that the state of a (discrete time) system is $s_t$ and $s_{t+1}$ at the time t and t+1 respectively. The dynamics of the system are described by a state transition function that gives the probability of the system state moving from $s_t$ to $s_{t+1}$ given control action at is $Pr(s_{t+1}|s_t, a_t)$. It is also assumed that the observation at time t+1 described by variable $z_{t+1}$. The sensor model refers to the probability of observing $z_{t+1}$ given that the system is in state $s_{t+1}$, i.e. $Pr(z_{t+1}|s_{t+1})$. The Baysian filter is now described by the following algorithm. The bel(s) refers to the belief in s or the probability density function over the states of the system bel(st+1) is the belief in state s following the process or prediction update that adjusts the state of the system based on its transition function. N is a normalising constant.

Algorithm 2 Baysian filter algorithm

Figure 5:
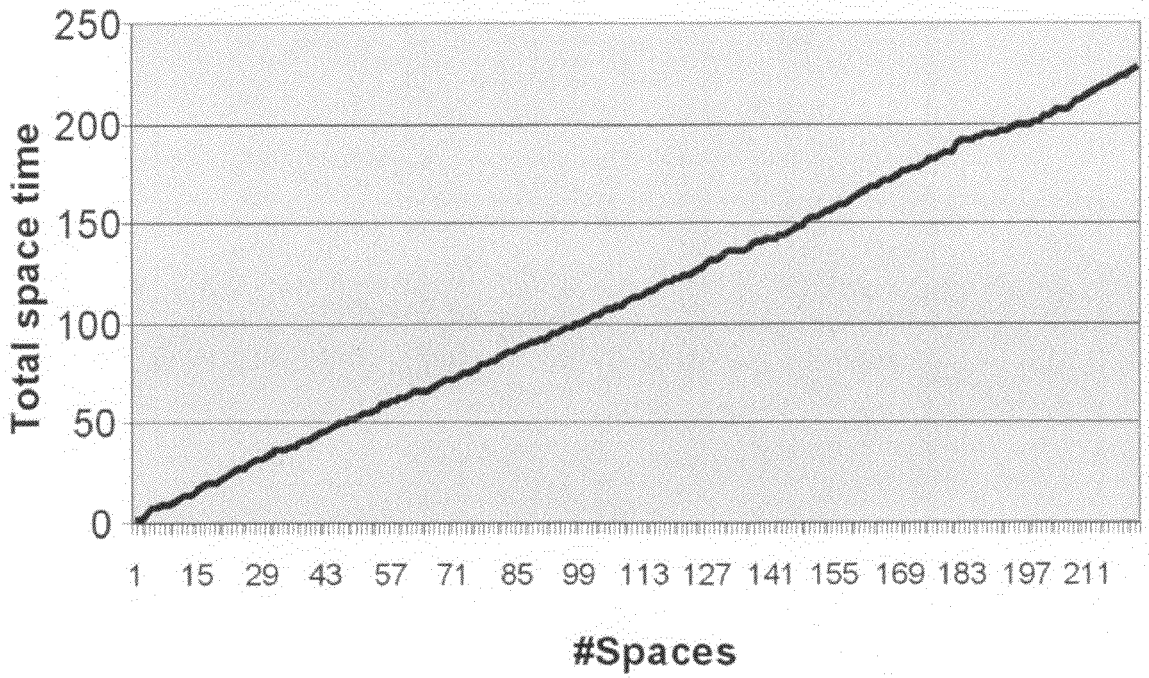
FIG. 5 shows a plot of total space-time (T) against number-of-spaces (S) for a discharging queue in one embodiment of the present invention.

1: BAYESFILTER $(bel(s_t), a_t, z_t)$:
2: for all $s_{t+1}$ do
3: $\overline{bel}(s_{t+1}) = \Sigma_{s_t} Pr(s_{t+1} \mid s_t, a_t) \cdot bel(s_t)$
4: $bel(s_{t+1}) = \eta \cdot Pr(z_{t+1} \mid s_{t+1}) \cdot \overline{bel}(s_{t+1})$
5: return $bel(s_{t+1})$ As shown in FIG. 5, the traffic model 16 (of FIG. 1) uses a real-time cumulative graph of Total Space-Time (T) vs number of space (S) to determine the End-of-Queue (EoQ), as the start of green light cycle is monitored in real-time. The EoQ is the point where the graph departs from the saturated flow curve and triggers when it intersects the trigger line. The EoQ is estimated from the intersection of lines representing saturated flow and under-saturated flow. From the start of the green light cycle, the EoQ time provides (1) a decision point for switching; and (2) a measure of traffic flow both vehicles/time and a variance based on the length of the red plus green light time.

To enhance the estimation, the Kalman filter can be used to estimate traffic flow rate and to update saturated flow rate (t) in real time.

Traffic Model

The traffic model is defined by the following equation.

$$G = \frac{q \times R \times (v - s)}{v \times (s - q)} \tag{5}$$

| Variable | Definition | Unit |
|---|---|---|
| Q | Rate at the queue grows | Meters/Second |
| S | Queue discharge rate (constant) | Meters/Second |
| V | Average traffic velocity (negative constant) | Meters/Second |
| R | Previous Red time | Seconds |
| G | Corresponding Demanding Green Time | Seconds |

Equation 5 can also be expressed as equation 6.

$$q = \frac{G \times v \times s}{R \times v + G \times v - R \times s} \tag{6}$$

FIG. 3 shows a graphical representation of equations 5 and 6 and shows the important relationship between the queuing rate (q) and the demanded green light time (G). Given that one can calibrate the constant discharge rate (s) and assuming a constant velocity (v) then:

(i) if the immediate red light time and the current queuing rate are known, it is possible to accurately estimate the green light time that is required to discharge the full queue by using equation 6; and (ii) if the previous red light time and the actual green light time that is used to discharge the full queue are known, it is possible to accurately derive a queuing rate observation q' by using equation 5.

The updated equation for the queuing rate is:

$$q'' = q \times (1 - \alpha) + q' \times \alpha \tag{7}$$

wherein $\alpha$ is the learning rate.

In equation 7, $\alpha$ is a constant that can be adjusted to control the sensitivity of the queuing rate tracker.

End-of-Queue Detection & Green Light Time

For the purpose of this document, the term "End-of-Queue" (EoQ) refers to the moment in time at which the entire queue is discharged during the green time on an approach in under-saturated traffic flow conditions.

It is observed that the sum of space-time increases approximately linearly with the sum of the space-count, while the queue is being discharged. The ratio of sum of space-time and the sum of space-count is approximately a constant and can be calibrated. Therefore:

$$t = \frac{T}{N^{10} + 1} \tag{8}$$

where T stands for the total space-time and N stands for the total number-of-spaces.

The expression t represents the calibrated constant.

It is also observed that there is an inverse relationship between the queuing rate q and average space time per vehicle overall t'. When the queuing rate increases, t' decreases. Using this relationship it is possible to calculate t', the average space-time per vehicle overall, from the tracked queuing rate q.

| Variable | Definition |
|---|---|
| d | The road meters per queued vehicle |
| v | The velocity in meters per second (a negative quantity) |
| f | The traffic flow rate in vehicles per second |
| q | The queuing rate in vehicles per second |
| Lv | Average length in meters per vehicle |
| Ls | Average space in meters between vehicles at velocity v |
| Ls* | Average space in meters between vehicles at saturation at velocity v |
| Ld | Length in meters of the loop detector |
| t | Space-time per vehicle at saturation, which is $-\frac{Ls^* - Ld}{v}$ |

Space-time per vehicle at flow rate f and velocity v, which is $$t' - \frac{Ls - Ld}{v}$$

o' Occupancy-time per vehicle at flow rate f and velocity v, which is $$-\frac{Lv + Ld}{v}$$

Equation 9 below can therefore be derived from the analytical queuing model in FIG. 3.

$$q = \frac{v \times f}{d \times f + v} \tag{9}$$

Equivalently, equation 10 can be derived from equation 9.

$$f = \frac{v \times q}{v - d \times q} \tag{10}$$

Now, since $$\begin{aligned} V &= \frac{\text{Distance}}{\text{Time}} \\ &= \frac{\text{Distance}}{\text{Vehicle}} \times \frac{\text{Vehicle}}{\text{Time}} \\ &= (Ls + Lv) \times f \\ &= (Ls - Ld + Ld + Lv) \times f \\ &= (t' + v - o'v) \times f \\ &= (t' + o') \times f \times v \end{aligned}$$

That is, $$1 = (t' + o') \times f \tag{11}$$

Equation 12 can be derived by substituting equation 11 to equation 9.

$$q = \frac{v}{v \times t' + v \times o' + d} \tag{12}$$

which is equivalent to:

$$q = \frac{1}{t' + o' + d/v} \tag{13}$$

In a preferable embodiment, the variables v, d and o' in this model are kept constant, and hence:

$$q = \frac{1}{t' + k} \tag{14}$$

where k is a constant.

$$\text{At saturation: } s = \frac{1}{t' + k} \tag{15}$$

$$\text{or: } k = \frac{1 - s \times t}{s} \tag{16}$$

Therefore, the equation can be expressed as:

$$q = \frac{s}{1 + s \times (t' - t)} \tag{17}$$

Figure 6:
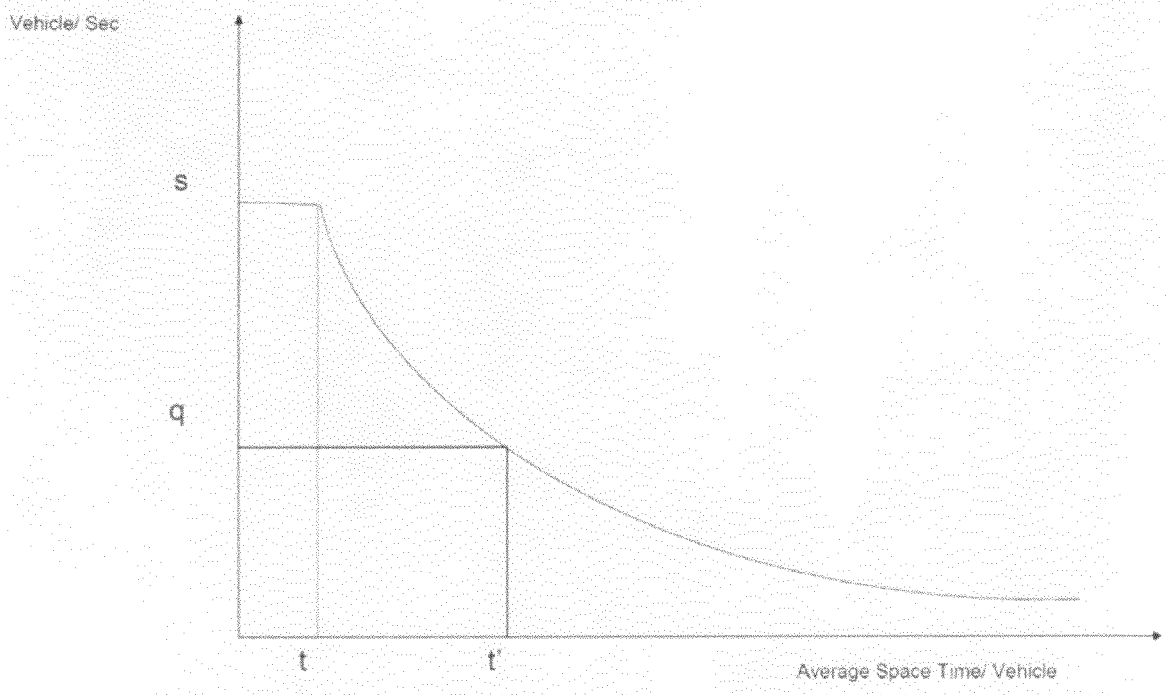
FIG. 6 shows graphical representation of the saturation state in one embodiment of the present invention.

As both s and t can be calibrated, given the current queuing rate q, we are able to approximate t'. The situation can be graphically depicted as in FIG. 6.

Figure 7:
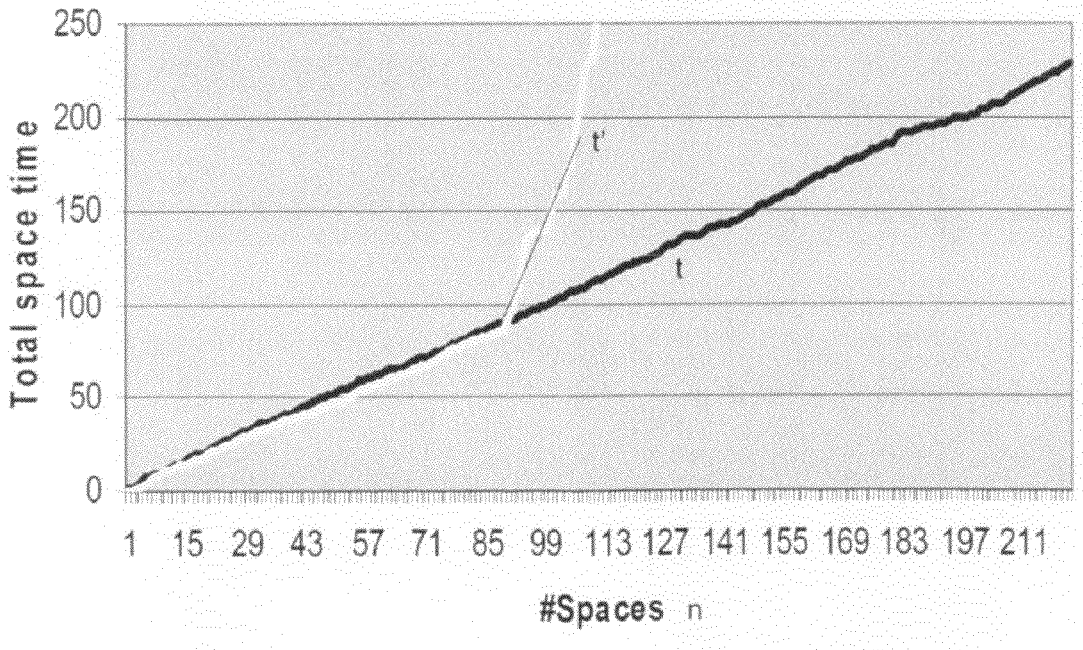
FIG. 7 shows a plot of number-of-spaces (n) against time (t) according to an embodiment of the present invention.

When the queue is discharged, the sum of space-time increases linearly with the sum of space-count, but at a higher gradient, t'. This situation can be graphically depicted as in FIG. 7.

There is a linear relationship between the number of spaces and the clock green light time while a queue is discharging.

The equation for the relation can be expressed as:

$$G = c \times v \tag{18}$$

Where G is the clock green time and n stands for the number of spaces. They are linked though constant c.

Traffic Flow Rate Tracking

Traffic flow is defined to be the average number of vehicles that pass a point on the road at a given time or during a given time interval. While this expected rate will usually vary during the day, in one embodiment, it is assumed to remain constant over the shorter term planning horizon of about 2 cycles of signal group changes.

The TSCS 10 attempts to accurately estimate the traffic flow, and subsequently used it to estimate the queuing rate during a red light phase and the expected green light time required to discharge a queue of traffic. The result, in turn, is used for projecting traffic queues forward in time under various control policies, with the objective of finding a policy that minimizes a cost function.

Given the stochastic inter-arrival rate of vehicles it may not be possible to observe the traffic flow directly. Therefore, the TSCS 10 tracks the traffic flow throughout the day by repeatedly taking measurements and updating the estimates. The quality of an estimate is a function of both the quality of a discrete measurement (in one embodiment, it is a constant), and the number of discrete measurements contributing to that estimate. The number of discrete measurements is a function of the measurement interval preceding the estimate calculation. The TSCS 10 therefore makes an estimate of the variance of the measurement based on the relevant measurement interval. In one embodiment, this measurement interval is the total time from the start of a red light, through the next subsequent green light, until the start of the next red light. In one embodiment, this 'feedback methodology' assumes that the previous past green light and following previous red light is indicative of the traffic flow for the next green light (and red light). The variance of traffic flow measurements is smaller the longer the red plus green light times.

The TSCS 10 evaluates the variance in order to adjust the gain in a Kalman filter and considerably improves the estimate of the green light time required to discharge the traffic queue. Kalman filter theory provides a disciplined method to calculate the change in gain for each measurement and is an improvement on the current TSCS that essentially uses a fixed gain.

The following sections derive the equations required for implementation for both adaptive phase control and flexible signal group control. The variables used for the calculation is defined as follows:

| Variable | Definition | Unit |
|---|---|---|
| f | Mean traffic flow rate of F (what we are tracking) | Vehicles/Second |
| F | Traffic flow rate random variable | Vehicles/Second |

-continued

| Variable | Definition | Unit |
|---|---|---|
| F; | i th sample from F of traffic flow rate | Vehicles/Second |
| F | Measurement of traffic flow rate | Vehicles/Second |
| $\sigma_F^2$ | Variance of F | Vehicles/Second |
| C | Previous red plus green times = R + G | Seconds |
| N | Adjusted space count from loop-detector | Vehicles |
| T | Total space-time | Seconds |
| t | Average space-time per discharging vehicle | Vehicles/Second |

In the definition, the use of C is different from the traditional Australian traffic engineering use of a cycle time that is more often phase-based and therefore considered an intersection-level variable. In the context used in this specification, C is a signal group-specific variable such that two signal groups within the one intersection may have different C values at any one time.

The TSCS 10 takes a measurement of the traffic flow and its variance and update the estimate of traffic flow will be discussed in the following sections.

Measurement

A measurement of the traffic flow F is taken by counting the number of spaces as measured by the loop-detector during the green light time and dividing by the elapsed red plus green light time C. The count N is adjusted by adding a fraction (between 0 and 1) to account for the possible space missed between the first and second vehicle as the queue discharges. When two spaces are observed, count N is increased by 1. For low traffic flow and short red light times it is more likely that only one vehicle is queued. When only one space is observed, the TSCS 10 therefore adds a fraction less than one. This can be represented as:

$$\overline{F} = \frac{N}{C} \tag{19}$$

Variance

The random variable F describes an arbitrary stationary distribution of vehicle arrivals per second with mean f and variance $\mathrm{var}(F)=\sigma_F^2$. In one embodiment, the underlying variance of F is assumed to be known and can be measured independently based on knowledge of upstream traffic conditions. In one embodiment, this is either specified together with the inflow rate, whereas in another embodiment, it can be measured directly by observing the inflow rate. The objective is to track (estimate) the mean traffic flow rate f.

After each green light, the TSCS 10 makes an observation of the traffic flow i.e. $\overline{F}$, and update the mean flow rate f. In one embodiment, it is assumed that the queue has been fully discharged at the end of the green light. Therefore, the observation of traffic flow that is being measuring includes traffic queued over the preceding red plus the green light intervals. Let C be the time in seconds of the sum of the red plus green light times. The TSCS 10 will calculate the variance of this measurement of f for C seconds of traffic flow. In one embodiment, it is assumed that the arrival of successive vehicles is independent identically distributed (MA).

$$\mathrm{var}(\overline{F}) = \mathrm{var}\left(\frac{\sum_{i=1}^{n} F_i}{C}\right) \tag{20}$$

-continued $$= \frac{1}{C^2}\sum_{i=1}^{n}\mathrm{var}(F_i)$$

$$= \frac{\sigma_F^2}{C}$$

This generalises that for any stationary distribution of traffic flow the variance of the measurement decreases inversely proportional to the length of the red plus green light time, C.

Variable Gain Kalman Filter

The recursive update for f uses a one-dimensional Kalman filter. The update procedure consists of these four steps executed repeatedly:

| Ordering | Procedure | Update Equation |
|---|---|---|
| 1 | Decay P the variance of flow rate we are tracking | $P \Leftarrow P + Q$ |
| 2 | Calculate the new Kalman gain from the observed measurement variance | $K \Leftarrow \frac{P}{P+R}$ |
| 3 | Apply the Kalman update with the new gain | $f \Leftarrow (F-1)f + K\overline{F}$ |
| 4 | Update new flow rate variance | $P \Leftarrow P(1-K)^2 f + RK^2$ |
| 5 | Go to Procedure 1 and repeat | |

P is the variance of the tracked flow rate. Q is the variance of the process noise. $R=\sigma_F^2/n$ is the measurement variance. A large C means a low R. The effect of a small R is to increase the gain K closer to 1. The gain is equivalent to the learning rate in reinforcement learning and a value close to 1 means that updates move the estimate faster to the observed value.

For the measurement F to be valid, typically, the queue is fully discharged when the measurement is calculated. One way to check this is to measure the degree of saturation during green and when it is less than 1, it is assumed that the queue has been fully discharged. Another method is to detect the end-of-queue during a green light signal and take the measurement any time subsequently.

End-of-Queue Detection

The objective of the TSCS 10 here is to determine the time-point when a queue is fully discharged. This time-point is defined as the time when the last vehicle in a discharging queue has crossed the stop-line. The end-of-queue measurement and the traffic flow rate estimation methods described in this paper are based on the aforementioned traffic queuing model. In one embodiment, it is assumed that vehicles travel at constant velocity as they approach the end of a queue and depart the queue at the same velocity. It is also assumed that whilst in the queue, the vehicles are stationary. The TSCS 10 has access to the occupancy data from a single loop-detector located just before the stop-line.

Cumulative Space-Time Plots

We observe that for a given green light time during the queue discharge period, the sum of space-time T increases approximately linearly with the sum of the space-counts N. The ratio to the sum of space-time to the sum of space-count is approximately a constant t and can be calibrated. This can be represented as follows:

$$t = \frac{T}{N+1}$$

Where, T is the total space-time and N is the total number of adjusted spaces.

In this way, t can be used to represent the calibrated constant, that is, the average space-time per discharging vehicle. When the end-of-queue is reached the flow rate reverts from saturation back to the normal flow rate. The space-time per vehicle increases and the cumulative plot of space-time verses number-of-spaces tracks at a steeper rate t', shown in FIG. 7.

Threshold Trigger

The end-of-queue is signalled by triggering the real-time plot above a threshold. The threshold triggers on a T value (total space-time). An end-of-queue is assumed to be detected if the actual total space-time exceeds the threshold line.

There are several ways to define the threshold function. Simple and effective triggering mechanisms are: parallel, flat, and a hybrid. The design of the trigger function is determined by the requirements of the particular intersection and is set by a traffic engineer. The system weighs up the risk of a false-positive and the insensitivity of the trigger. The three threshold triggering schemes are shown in FIGS. 8, 9, and 10 respectively.

Figure 8:
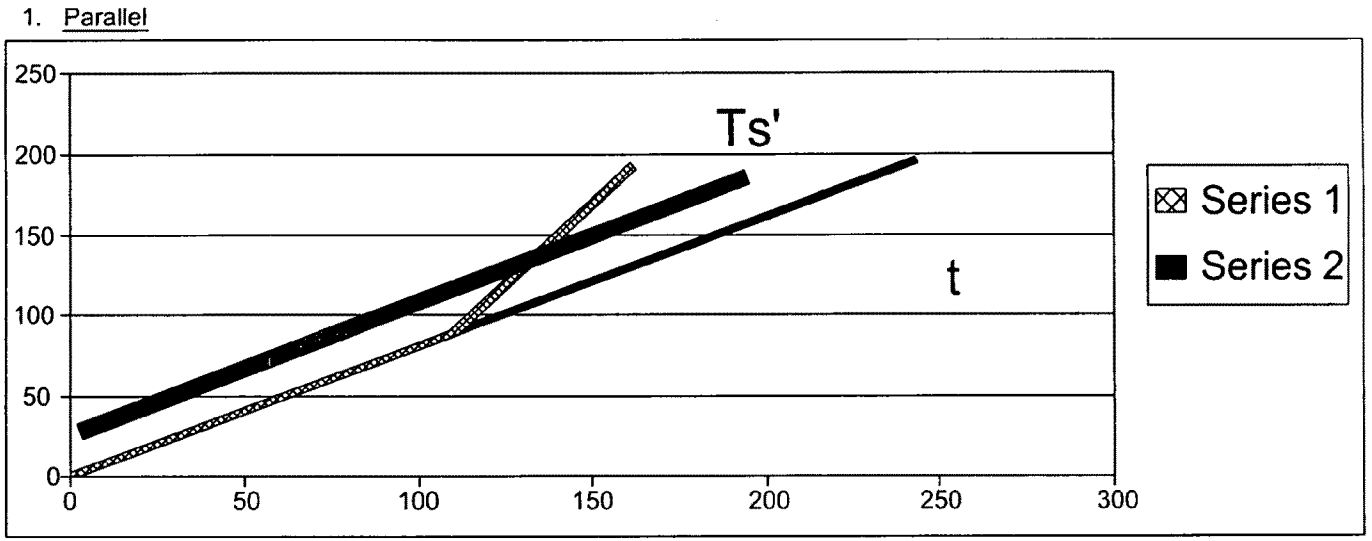
FIG. 8 shows a plot of a threshold function according to an embodiment of the present invention.
Figure 9:
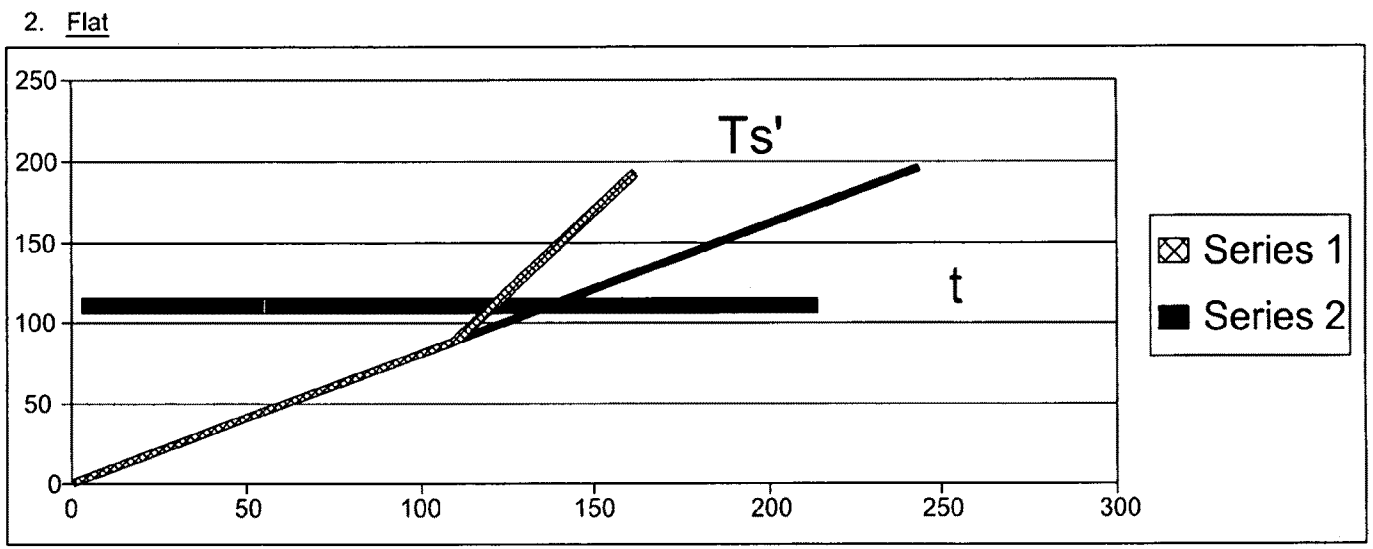
FIG. 9 shows a plot of another threshold function according to an embodiment of the present invention.
Figure 10:
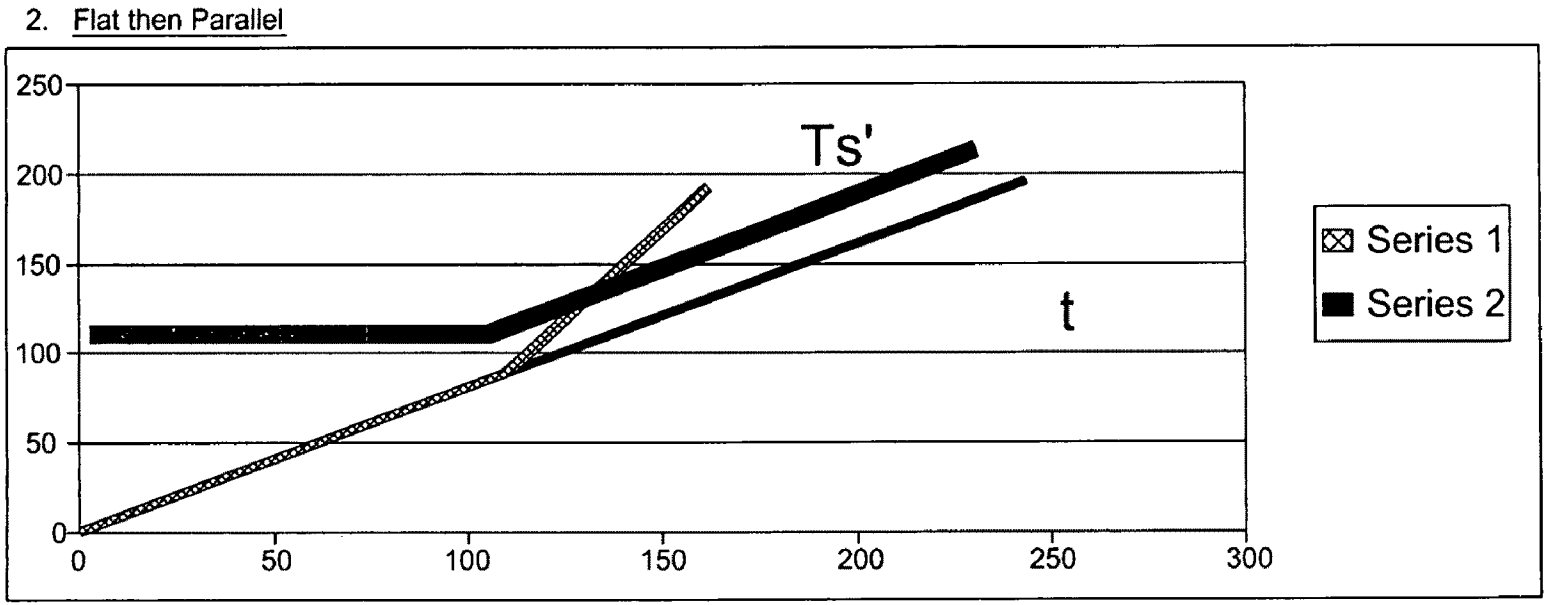
FIG. 10 shows a plot of a third threshold function according to an embodiment of the present invention.

As can be seen from FIGS. 8, 9 and 10, the time-point at which the end-of-queue triggers is some time after the actual end-of-queue. A controller can of course only react at the time of the event trigger. However, for the purposes of updating the traffic flow rates or queuing rates, it is possible to calculate the true end-of-queue green light time requirements to give better estimations.

For under-saturated traffic conditions, the end-of-queue methodology will always work to bias the green light time to provide more green light time than is necessary. The excess is a function of the trigger mechanism. The effect is to run a controller with a degree of saturation less than one when the controller "maximum constraints" are not applied, e.g., maximum red light time (or maximum cycle time). The significant advantage of this approach is that a controller, when subject to non-maximum constrained under-saturated conditions, will always have access to an accurate forecast of flow.

The advantage of the above methodology is best understood by comparing to the inferior alternative approach of allowing the controller to give a green light time that is too low within under-saturated conditions, i.e., such that the degree of saturation is greater than one. This results in the controller being unable to estimate the green light time that was required and therefore unable to make an estimate of the previous flow.

Non-linear Little t

Noticing the implications of a blocked lane, e.g., blocked right turn lane, road work and weather conditions, will all have an impact on the characteristics of the accumulative space time and space count function.

In one embodiment, the accumulative space time is a linear function of accumulative space count during queue discharging. In another embodiment, this function to be non-linear and it could be calibrated automatically online, thus avoid manual input from human as well as making End of Queue detection more accurate.

The little t function data can be stored in a table, a table initially filled with values in pink line that reflects constant little t. Function update is done by repeatedly updating the corresponding accumulate space time for each possible accumulate space count value. For each update a discount factor a=0.3 is used. The following table illustrate the process of updating the little t lookup table for the first 4 observation updates.

| Acc. Space Count | Acc. Space Time (State 0) | 1st Observation | Acc. Space Time (State 1) | 2nd Observation | Acc. Space Time (State 2) | 3rd Observation | Acc. Space Time (State 3) | 4th Observation | Acc. Space Time (State 4) |
|---|---|---|---|---|---|---|---|---|---|
| 0 | 0 | 0 | 0 | 0 | 0 | 0 | 0 | 0 | 0 |
| 01 | 1100 | 733 | 990 | 500 | 843 | 1230 | 959 | 838 | 923 |
| 2 | 2200 | 1774 | 2072 | 745 | 1674 | 1434 | 1602 | 1595 | 1600 |
| 3 | 3300 | 2578 | 3083 | 1521 | 2615 | 1599 | 2310 | 2631 | 2406 |
| 4 | 4400 | 3570 | 4151 | 3511 | 3959 | 2852 | 3627 | 3765 | 3668 |
| 5 | 5500 | 4659 | 5248 | 4644 | 5067 | 5091 | 5074 | 5702 | 5262 |
| 6 | 6600 | 5832 | 6370 | 4892 | 5926 | 5420 | 5774 | 8250 | 6517 |
| 7 | 7700 | 7080 | 7514 | 7241 | 7432 | 6012 | 7006 | 8453 | 7440 |
| 8 | 8800 | 7373 | 8372 | 7586 | 8136 | 7355 | 7902 | 9666 | 8431 |
| 9 | 9900 | 8727 | 9548 | 9471 | 9525 | 9662 | 9566 | 11568 | 10167 |
| 10 | 11000 | 10096 | 10729 | 10770 | 10741 | 10112 | 10552 | 11871 | 10948 |
| 11 | 12100 | 11483 | 11915 | 11108 | 11673 | 11567 | 11641 | 13221 | 12115 |
| 12 | 13200 | 11915 | 12815 | 12473 | 12712 | 12997 | 12798 | 14599 | 13338 |
| 13 | 14300 | 13360 | 14018 | 12862 | 13671 | 14434 | 13900 | 15998 | 14529 |
| 14 | 15400 | 13794 | 14918 | 14272 | 14724 | 14896 | 14776 | 17422 | 15570 |
| 15 | 16500 | 15238 | 16121 | 15710 | 15998 | 16373 | 16110 | 17856 | 16634 |
| 16 | 17600 | 16666 | 17320 | 17113 | 17258 | 16817 | 17126 | 19168 | 17738 |
| 17 | 18700 | 18083 | 18515 | 17605 | 18242 | 18264 | 18249 | 20480 | 18918 |
| 18 | 19800 | 19536 | 19721 | 18929 | 19483 | 19667 | 19538 | 20935 | 19957 |
| 19 | 20900 | — | 20900 | — | 20900 | — | 20900 | — | 20900 |
| 20 | 22000 | — | 22000 | — | 22000 | — | 22000 | — | 22000 |

The End-of-Queue trigger function can be built upon the calibrated little t table to the aforementioned threshold triggering schemes.

While the invention has been described with reference to preferred embodiments above, it will be appreciated by those skilled in the art that it is not limited to those embodiments, but may be embodied in many other forms.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as "comprise", etc.

INDUSTRIAL APPLICABILITY

The present invention can be used as a method for controlling traffic lights at intersections.

In particular, the present invention can be used a system and to a software platform for carrying out a method of controlling and switching of signal groups at intersections to optimise the flow of traffic based on utility functions. Similarly, the present invention can be used as a traffic control system, which monitors and controls the traffic on roads.

The invention claimed is:

1. A method of controlling traffic signals at a road intersection which has a plurality of signal groups, each signal group controlling at least one direction of traffic within the intersection, the method executed by a controller and comprising steps:

(i) obtaining and utilising traffic data to calculate a current traffic state and the rate of change in the traffic state;

(ii) formulating at least one action and the duration of said action in response to the calculations obtained in step (i), wherein each action comprises switching at least one traffic signal;

(iii) resolving one or more policies based on the calculations obtained in step (i) and the action formulated in step (ii);

(iv) applying a continuous decision making process comprising an optimisation for a semi-Markov decision process to evaluate a reward for the policies resolved in step (iii), said optimisation comprising steps:

(a) generating a policy pathway comprising a plurality of different paths, each path having one or more nodes, which represent at least one policy; and (b) evaluating a reward for each path in the policy pathway by evaluating and totaling the reward of the policies located at each node along each one of the different paths; and (v) selecting a policy that maximizes the reward and switching at least one traffic signal according to the selected policy.

2. The method of claim 1, wherein the current traffic state comprises one or more of traffic queue length, vehicle speed, vehicle position, vehicle type, and arrival rate.

3. The method of claim 1, wherein the current traffic state comprises a traffic queue length, and the rate of change is the rate of growth of the traffic queue.

4. The method of claim 1, wherein the optimisation is adapted to terminate when a termination condition is reached within the policy pathway.

5. The method of claim 4, wherein the termination condition is selected from one or more of the node count limit, the time count limit or the storage count limit.

6. The method of claim 1, wherein the evaluated reward is a value of a function for optimising at least one traffic condition.

7. The method of claim 6, wherein the traffic condition is any one or more of vehicle fuel consumption, pollution, the number of vehicle stops, vehicle waiting time and time delay.

8. The method of claim 1, wherein the continuous decision making process comprises a set of states and a set of actions for transitioning between states and a policy comprises mapping states to actions, wherein a state comprises at least one signal group state and one traffic state.

9. The method of claim 8, wherein the signal group state comprises a plurality of signals and a counter for each signal.

10. The method of claim 9, wherein the signals comprise red and green.

11. The method of claim 9, wherein the counter stores an amount of time remaining before the signal can be switched.

12. The method of claim 1, wherein the traffic data is received from a sensor.

13. The method of claim 12, wherein the sensor comprises any one or more of a loop detector, video camera, radar device, infra-red sensor, RFID tag or GPS device.

14. The method of claim 1, wherein the step of calculating the traffic state comprises the step of determining the end-of-queue of the incoming traffic.

15. The method of claim 14, wherein the end-of-queue is determined using total space-time and number of spaces.

16. A traffic signals control system comprising a controller for controlling actuators for the controlling of traffic signals at a road intersection which has a plurality of signal groups, each signal group controlling at least one direction of traffic within the intersection, and a traffic modeling device arranged to receive traffic data from a sensor, the controller being operable to:

(i) obtain and utilise the traffic data to calculate a current traffic state and the rate of change in the traffic state;

(ii) formulate at least one action and the duration of said action in response to the calculations obtained in step (i), wherein each action comprises switching at least one traffic signal;

(iii) resolve one or more policies based on the calculations obtained in step (i) and the action formulated in step (ii);

(iv) apply a continuous decision making process comprising an optimisation for a semi-Markov decision process to evaluate a reward for the policies resolved in step (iii), said optimisation comprising:

(a) generation of a policy pathway comprising a plurality of different paths, each path having one or more nodes, which represent at least one policy; and (b) evaluation of a reward for each path in the policy pathway by evaluating and totaling the reward of the policies located at each node along each one of the different paths; and (v) select a policy that maximizes the reward.

17. The traffic control system of claim 16, wherein the current traffic state comprises one or more of traffic queue length, vehicle speed, vehicle position, vehicle type, and arrival rate.

18. The traffic control system of claim 16, wherein the current traffic state comprises a traffic queue length and the rate of change is the rate of growth of the traffic queue.

19. The traffic control system of claim 16, wherein the optimisation is adapted to terminate when a termination condition is reached within the policy pathway.

20. The traffic control system of claim 19, wherein the termination condition is selected from one or more of the node count limit, the time count limit or the storage count limit.

21. The traffic control system of claim 16, wherein the evaluated reward is a value of a function for optimising at least one traffic condition.

22. The traffic control system of claim 21, wherein the traffic condition is any one or more of vehicle fuel consumption, pollution, the number of vehicle stops, vehicle waiting time and time delay.

23. The traffic control system of claim 16, wherein the continuous decision-making process comprises a set of states and a set of actions for transitioning between states and a policy comprises mapping states to actions, wherein a state comprises at least one signal group state and one traffic state.

24. The traffic control system of claim 23, wherein the signal group state comprises a plurality of signals and a counter for each signal.

25. The traffic control system of claim 24, wherein the signals comprise red and green.

26. The traffic control system of claim 24, wherein the counter stores an amount of time remaining before the signal can be switched.

27. The traffic control system of claim 16, wherein the sensor comprises any one or more of a loop detector, video camera, radar device, infrared sensor, RFID tag or GPS device.

28. The traffic control system of claim 16, wherein the step of calculating the traffic state comprises the step of determining the end-of-queue of the incoming traffic.

29. The traffic control system of claim 28, wherein the end-of-queue is determined using total space-time and number of spaces.

* * * * *